US008307490B2

(12) United States Patent
Gringer et al.

(10) Patent No.: US 8,307,490 B2
(45) Date of Patent: Nov. 13, 2012

(54) MULTIFUNCTION CAULK TOOL

(75) Inventors: Donald Gringer, New York, NY (US); Howard Soled, Paramus, NJ (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 309 days.

(21) Appl. No.: 12/711,670

(22) Filed: Feb. 24, 2010

(65) Prior Publication Data

US 2011/0203064 A1 Aug. 25, 2011

(51) Int. Cl.
*B05C 17/10* (2006.01)

(52) U.S. Cl. ..... 15/105; 15/235.7; 15/235.8; 15/236.01; 15/236.05; 15/236.06; 15/236.09

(58) Field of Classification Search ..... 15/105, 15/105.5, 235.3, 235.4, 235.7, 235.8, 236.01, 15/236.05, 236.06, 237.07, 236.08, 236.09
See application file for complete search history.

(56) References Cited

U.S. PATENT DOCUMENTS

| | | | | | |
|---|---|---|---|---|---|
| 656,468 | A | | 8/1900 | Mullin et al. | |
| 693,518 | A | | 2/1902 | Hamilton | |
| 736,741 | A | | 8/1903 | Klemm | |
| 912,028 | A | * | 2/1909 | Prout | 30/169 |
| 946,723 | A | * | 1/1910 | Coffin | 30/165 |
| 952,746 | A | | 3/1910 | Lane | |
| 1,068,683 | A | | 7/1913 | Malek | |
| 1,195,297 | A | * | 8/1916 | Vlchek | 30/169 |
| 1,463,745 | A | | 7/1923 | Layne | |
| 1,558,509 | A | * | 10/1925 | Schweitzer | 15/147.1 |
| 1,584,021 | A | | 5/1926 | Melvin | |
| 2,119,045 | A | | 5/1938 | Deitrich | |
| 2,286,190 | A | | 6/1942 | Abrahamsen | |
| 2,336,284 | A | | 12/1943 | Nelson | |
| 2,380,855 | A | * | 7/1945 | Lower | 15/236.05 |
| 2,783,537 | A | | 3/1957 | Gringer | |
| 2,846,764 | A | | 8/1958 | Hyneman | |
| 3,018,499 | A | * | 1/1962 | Levy | 15/235.4 |

(Continued)

FOREIGN PATENT DOCUMENTS

DE 3420639 A1 * 12/1985

(Continued)

OTHER PUBLICATIONS

Allway Tools, Soft Grip Tools for Hard Hat Jobs, 2008.

(Continued)

*Primary Examiner* — Robert Canfield
*Assistant Examiner* — Charissa Ahmad
(74) *Attorney, Agent, or Firm* — Gottlieb, Rackman & Reisman, P.C.

(57) ABSTRACT

A preferred embodiment of a caulk tool comprises a body member having a raised handle and two working heads. The first working head is adapted for the application of caulk and is connected to the first descending end of the raised handle. The first working head preferably comprises a triangular member formed of soft plastic material. The triangular member is rotatable, having three tips of varying size. The second working head is adapted for the removal of old caulk and is connected to the second descending end of the raised handle axially opposed to the first working head. The second working head preferably comprises a metallic head having two tips suited to remove old caulk. In a preferred embodiment, a third working head in the form of a flat scraper is positioned adjacent to said second working head.

37 Claims, 3 Drawing Sheets

U.S. PATENT DOCUMENTS

| | | | | | |
|---|---|---|---|---|---|
| 3,162,947 | A | | 12/1964 | Gringer | |
| 3,230,566 | A | * | 1/1966 | Moody | 15/235.3 |
| 3,250,000 | A | | 5/1966 | Schumman | |
| 3,351,969 | A | * | 11/1967 | Cline | 15/245 |
| 3,667,122 | A | | 6/1972 | Black | |
| 3,688,401 | A | | 9/1972 | Hartman | |
| 3,761,992 | A | * | 10/1973 | Schneller | 15/210.1 |
| 3,821,828 | A | * | 7/1974 | Pearson | 15/245.1 |
| 3,892,039 | A | * | 7/1975 | Fisher | 30/279.2 |
| D240,699 | S | | 7/1976 | Gerson | |
| 4,211,501 | A | * | 7/1980 | Pedroso et al. | 401/261 |
| D267,826 | S | | 2/1983 | Gringer | |
| D274,952 | S | | 7/1984 | Gringer | |
| D274,953 | S | | 7/1984 | Gringer | |
| 4,558,517 | A | | 12/1985 | Gringer | |
| D282,881 | S | | 3/1986 | Gringer | |
| 4,698,870 | A | * | 10/1987 | Clark | 15/105.5 |
| 4,768,254 | A | * | 9/1988 | Bell | 15/236.01 |
| 5,056,226 | A | | 10/1991 | Gringer | |
| 5,072,486 | A | * | 12/1991 | Guarascio | 15/401 |
| 5,075,916 | A | * | 12/1991 | Englehart | 15/245.1 |
| D326,546 | S | | 5/1992 | Gringer | |
| D332,901 | S | * | 2/1993 | Campbell | D8/45 |
| 5,239,725 | A | * | 8/1993 | White | 15/105.5 |
| D343,559 | S | * | 1/1994 | Liberty | D8/45 |
| D346,319 | S | | 4/1994 | Lavalle et al. | |
| 5,309,598 | A | * | 5/1994 | Carpenter | 15/236.08 |
| 5,349,716 | A | * | 9/1994 | Millar | 15/245 |
| RE34,979 | E | | 6/1995 | Gringer | |
| 5,433,004 | A | | 7/1995 | Thompson et al. | |
| D364,252 | S | | 11/1995 | Henke | |
| 5,491,896 | A | * | 2/1996 | Stolzer et al. | 30/169 |
| 5,528,832 | A | | 6/1996 | Schmidt | |
| 5,781,956 | A | * | 7/1998 | Kelsay et al. | 15/143.1 |
| D420,882 | S | * | 2/2000 | Majolo et al. | D8/98 |
| 6,035,536 | A | | 3/2000 | Dewberry | |
| 6,219,878 | B1 | | 4/2001 | Dewberry | |
| D453,251 | S | | 1/2002 | Gringer et al. | |
| D463,639 | S | | 9/2002 | Panfili et al. | |
| 6,442,846 | B1 | * | 9/2002 | Michael | 30/322 |
| D467,395 | S | | 12/2002 | McCool | |
| D468,989 | S | | 1/2003 | Gringer et al. | |
| 6,530,098 | B1 | | 3/2003 | Gringer et al. | |
| 6,568,087 | B1 | | 5/2003 | Gringer | |
| 6,578,229 | B1 | * | 6/2003 | Dziallas et al. | 15/236.05 |
| D479,374 | S | | 9/2003 | Gringer et al. | |
| D479,375 | S | | 9/2003 | Gringer et al. | |
| D489,851 | S | | 5/2004 | Jones et al. | |
| 6,732,395 | B2 | | 5/2004 | Gringer | |
| 6,964,100 | B1 | | 11/2005 | Misland et al. | |
| D516,263 | S | | 2/2006 | Gringer et al. | |
| D537,591 | S | | 2/2007 | Gringer et al. | |
| 7,543,350 | B2 | * | 6/2009 | Cheney et al. | 15/235.4 |
| D605,911 | S | * | 12/2009 | Lian et al. | D8/14 |
| D634,600 | S | * | 3/2011 | Gringer et al. | D8/98 |
| 7,950,099 | B1 | * | 5/2011 | Hanson et al. | 15/105 |
| 2003/0110570 | A1 | * | 6/2003 | Gringer | 7/100 |
| 2003/0110641 | A1 | | 6/2003 | Gringer | |
| 2006/0080843 | A1 | | 4/2006 | Gringer et al. | |
| 2006/0200932 | A1 | * | 9/2006 | Byrnes | 15/236.06 |
| 2008/0034525 | A1 | * | 2/2008 | Panfili et al. | 15/236.01 |
| 2008/0209657 | A1 | * | 9/2008 | Hoffmann et al. | 15/236.01 |
| 2010/0162509 | A1 | * | 7/2010 | Liao | 15/235.7 |
| 2010/0162573 | A1 | * | 7/2010 | Liao | 30/169 |

FOREIGN PATENT DOCUMENTS

| | | | |
|---|---|---|---|
| GB | 2111575 | A * | 7/1983 |
| WO | 00/06347 | | 2/2000 |

OTHER PUBLICATIONS

Tile Installation Tools, ACE Industial, (NINGBO) Co., Ltd, 2005.

Stanley Hand Tools, www.stanleytools.com., 2002-2005.

* cited by examiner 10
12
14
16
17
18
20
22
24
26
28
30
32
34
40
42
43
44
45
46
47
48
60
62
64
66
6

MULTIFUNCTION CAULK TOOL

FIELD OF INVENTION

The present application relates generally to a multifunction caulk tool. More specifically, the invention involves an improved caulk tool for use in both the application of fresh caulk and grout, as well as the removal of old caulk and grout.

BACKGROUND OF THE INVENTION

A number of tools designed for use in connection with the task of caulking have been around for some time. Some of these tools are specifically designed for the application of fresh caulk (e.g., to seal a shower area), and others are specifically designed for the removal of old caulk when it becomes dry and ineffective as a sealer.

When it comes to the application of caulk, one handheld caulking tool is disclosed in U.S. Pat. No. 6,219,878. The tool includes an elongated handle and triangular head with working edges. The working edges are two edges of an arrow-shaped flat sheet formed of an elastomer or gasket rubber-like material. The edges form an acute angle that is rounded to achieve the desired finished form of a concave bead of caulk. The sheet is rigidly held by and extends slightly beyond the triangular head. The handle contains a continuous longitudinal cavity for the collection of excess caulk gathered during operation of the tool.

Despite its proposed utility, this tool suffers from a number of deficiencies. For example, the arrow-shaped sheet attached to the triangular head is limited to a single rounded point of contact which does not effectively accommodate caulk beads of varying widths. In particular, such a tool yields inconsistent and sometimes messy results in the context of either a single seal with varying widths along the length of the seal, and/or multiple seals eaching having different widths. This is a significant problem for contractors and handymen and their customers who desire a professional and neat job. In addition, this tool is limited to the application of caulk, requiring a user to carry a separate tool for removing caulk. Moreover, because the cavity runs the entire length of the handle, the tool is fragile and more prone to break or crack in the vicinity of the handle.

When it comes to the removal of cured caulk, one handheld caulk bead removal tool is disclosed in U.S. Pat. No. 6,035,536. The tool includes an elongated handle with two working heads. The primary head is located at one end of the handle and features a chisel-like point positioned between two symmetrical, angled, flanking planes to chisel the body of a caulk bead from a joint. The other head, located axially opposite the primary head, is essentially a chisel-like point that is used to chisel, pick or gouge a bead from a joint. The handle of this tool also contains a continuous longitudinal cavity.

This tool also suffers from a number of deficiencies. In particular, the configuration of the primary head limits the effectiveness of the tool to joints that have opposition surfaces that can accommodate the symmetrical planes of the tool. According to U.S. Pat. No. 6,035,536, the angled planes act to support the cutting and chiseling central point by seating firmly against both adjacent surfaces to a caulked joint. This feature may result in at least two problems. First, if the surfaces adjacent to the joint form a very narrow space, the primary head will not fit and the tool cannot be used to remove the caulk from the joint. Second, if the adjacent surfaces form a large gap (or if there are no adjacent surfaces against which the planes of the tool can be seated), there is no support of the cutting and chiseling central point, resulting in ineffective removal of caulk or perhaps undesirable breaking or bending of the tool. In addition to the foregoing, this tool is limited to the removal of cured caulk, requiring a user to carry a separate tool for the application of caulk. Moreover, like its counterpart disclosed in U.S. Pat. No. 6,219,878, since the cavity runs the entire length of the handle, the tool is fragile and more prone to break or crack in the vicinity of the handle.

An example of another caulk removal tool is presented in FIG. 1. The tool comprises a handle connected to a metallic head with two working tips—a forward tip and a rearward tip, each adapted to remove caulk from a joint. One deficiency in this tool is that there is insufficient clearance between the rearward tip and a user's fingers when the rearward tip is used to remove caulk with a pulling motion. Since the top surface of the handle is nearly parallel to the bottom surface of the metallic head, the rearward tip is not sufficiently inclined in the ordinary course of use of the tool to remove caulk from a joint.

SUMMARY OF THE INVENTION

In view of the deficiencies and drawbacks in the prior art, it is a primary object of the present invention to provide a caulk tool that is adapted to effectively and efficiently apply fresh caulk and remove cured or old caulk;

Another object of the present invention to provide a caulk tool that effectively accommodates caulk beads of varying widths, both in connection with the application and removal of caulk;

Yet another object of the present invention is to provide a solid caulk tool that is sturdy and resistant to cracking along the length of the handle;

Additional objectives will be apparent from the description of the invention that follows.

In summary, there is provided in a preferred embodiment of the present invention an improved caulk tool having a body that forms a raised handle connected to at least two working heads. The first working head is adapted for the application of caulk and is connected to the first end of the raised handle. The first working head preferably comprises a triangular member formed of a soft plastic material. The triangular member is rotatable, having three tips of varying size that can smooth caulk beads of varying widths evenly and without a mess. The second working head, which is adapted for the removal of old caulk, is connected to the second end of the raised handle and is axially opposed to the first working head. The second working head preferably comprises a metallic head having two tips suited to remove old, loose, dried and/or crumbling caulk from a joint or other space where caulk may have been applied.

Optionally, a third working head in the form of a flat scraper that may assist in the removal of old caulk and debris can be applied adjacent to one or both of the first and/or second working heads.

Additional features of the invention are described below in more detail.

BRIEF DESCRIPTIONS OF THE DRAWINGS

The above-described and other advantages and features of the present disclosure will be appreciated and understood by those skilled in the art from the following detailed description and drawings of which FIG. 1 is a right side elevational view of a prior art caulk removal tool described previously;

DETAILED DESCRIPTION OF THE INVENTION

Figure 1:
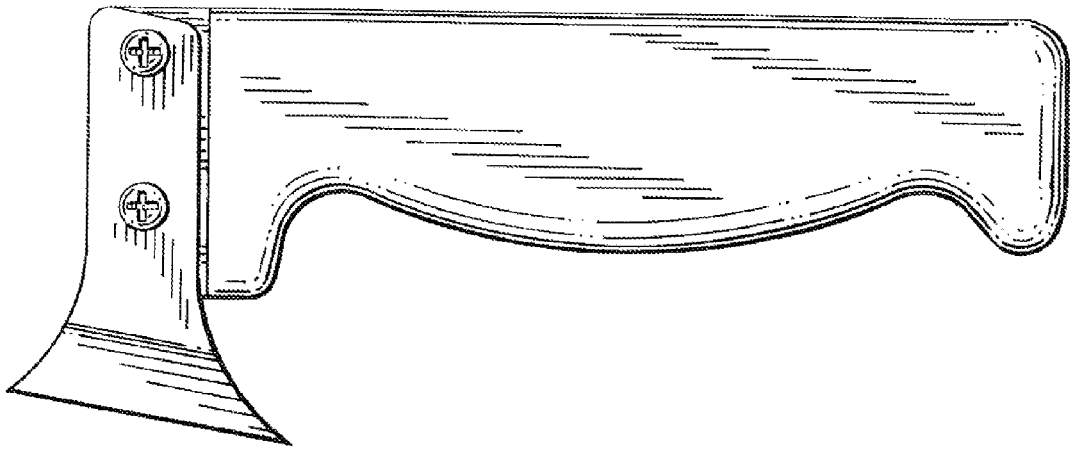
FIG. 1 PRIOR ART

With reference to FIGS. 1 through 7, there is shown a preferred embodiment of a multifunction caulk tool 10 of the present invention. Generally, the caulk tool 10 has an elongated body 12 that forms a raised handle 14. The body 12 and handle 14 are preferably formed of a hard plastic material. Preferably, POM (polyoxymethylene) or acetyls sold under the brand names Delrin® or Celcon® may be utilized, but other materials, including engineering plastics, nylon, Lexan® polycarbonate resin and polypropylene may be utilized as well, if desired. The handle 14 has a soft cover 16 overlying at least a portion of the handle 14 to provide a comfortable surface for gripping the caulk tool 10. The soft cover 16 is preferably formed of a thermoplastic elastomer, such as Santoprene. In the preferred embodiment, the soft cover 16 is dual molded to the hard plastic core that forms the handle 14.

Connected to the body 12 at the descending ends 17, 18 of the handle 14, respectively, are a first working head 20 adapted to apply fresh caulk and a second working head 40 adapted to remove old caulk. The first working head 20 preferably comprises a triangular smoothing member 22 formed of a soft silicon rubber material. Alternatively, other materials, such as soft plastics, may be utilized in forming the triangular smoothing member. It is preferable for the material to be a relatively low-friction material. The triangular member 22 is adapted to form a concave surface after fresh caulk is applied to a space or joint by passing the triangular member along the caulk. As shown most clearly in FIGS. 3 and 4, the triangular member 22 forms an irregular triangle defined by three curved tips 24, 26, 28, each of which is sized to accommodate a joint or space of a different width. In a preferred embodiment, curved tip 24 is sized to accommodate a 3/16" joint, curved tip 26 is sized to accommodate a slightly larger 1/4" joint and curved tip 28 is sized to accommodate and even wider 3/8" joint. While the preferred embodiment of the triangular member 22 is intended to accommodate a 3/16" joint, a 1/4" joint and a 3/8" joint, it should be understood that the triangular member 22 can be modified, if needed, to accommodate joints (or spaces) of smaller (e.g., 1/8") or larger (e.g., 1/2" or 5/8") sizes than those specifically provided in connection with the preferred embodiment.

The triangular member 22 is fitted over a triangular appendage 30 at the descending end 17 of the handle 14 by inserting the appendage 30 inside a cavity through an aperture 32 at the top of the triangular member 22. Although the triangular member 22 is snugly secured over the triangular appendage 30 to prevent it from rotating freely and/or becoming unintentionally detached, there is sufficient flexibility in the material of the triangular member 22 to allow it to be manually rotated by a user with a moderate amount of force. The triangular member 22 can be rotated both clockwise and counterclockwise about appendage 30 into the positions that enable use of all three curved tips 24, 26, 28 to be in contact with a caulk bead. For example, using FIG. 4 as a reference, if curved tip 26 is pointed forward, a user can rotate the triangular member 22 clockwise until curved tip 28 is fixed into the forward position for use or counterclockwise until curved tip 24 is fixed into the forward position for use. During use of the first working head 20, each of the curved tips 24, 26, 28 on the lower platform 34 of the triangular member 22 bends or flexes sufficiently to create a neat concave caulk bead.

In connection with the first working head 20, it should further be understood that that a number of alternatives may be incorporated while still keeping within the spirit and scope of the invention. For example, it should be understood that similarly sized pointed tips may be utilized instead of the curved tips 24, 26, 28. Moreover, while the triangular configuration is preferred for the smoothing member, it may be desirable to utilize a soft plastic or rubber member having a different geometrical configuration, such as a square, diamond or pentagon, so long as the member's tips are sufficiently separated so as not to interfere with one another during the caulking process. If a member with a different geometric configuration is utilized, a corresponding change to the appendage at the descending end of the handle should be incorporated to promote proper rotation of the member.

Figure 2:
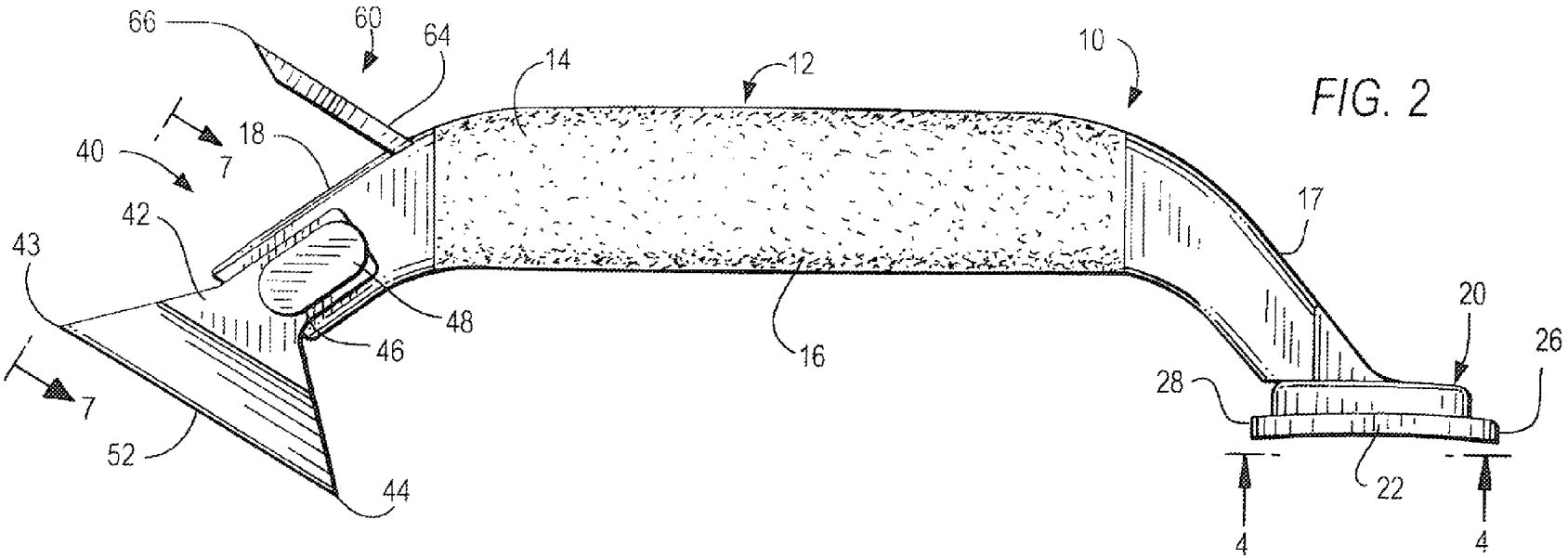
FIG. 2 is a left side elevational view a first preferred embodiment of a multifunction caulk tool with a first head, a second head and a third head, made in accordance with the present invention.
Figure 3:
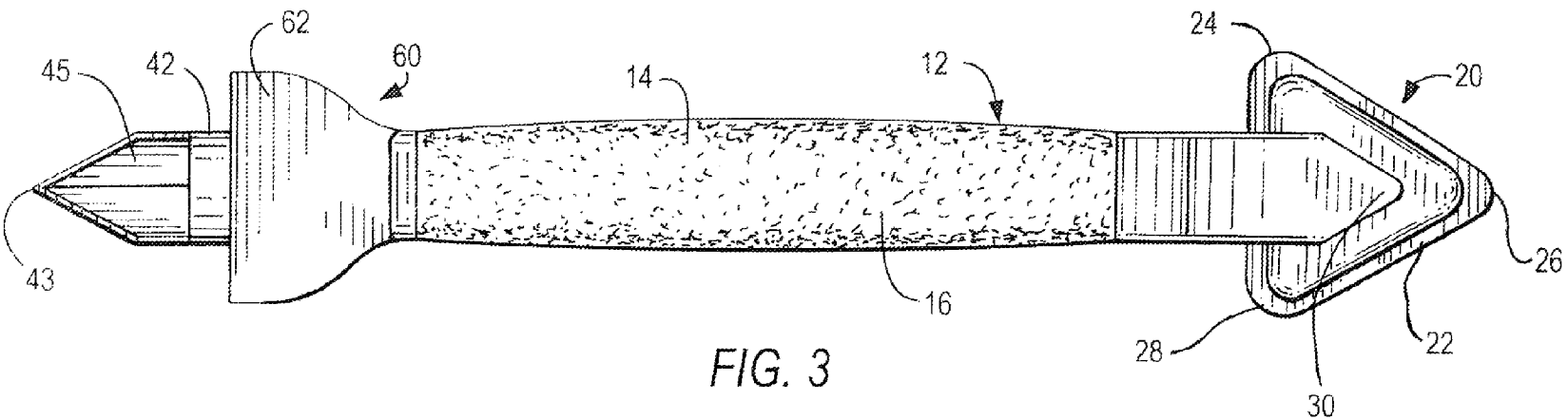
FIG. 3 is a top plan view of multifunction caulk tool shown in FIG. 2
Figures 4, 5, 6, 7:
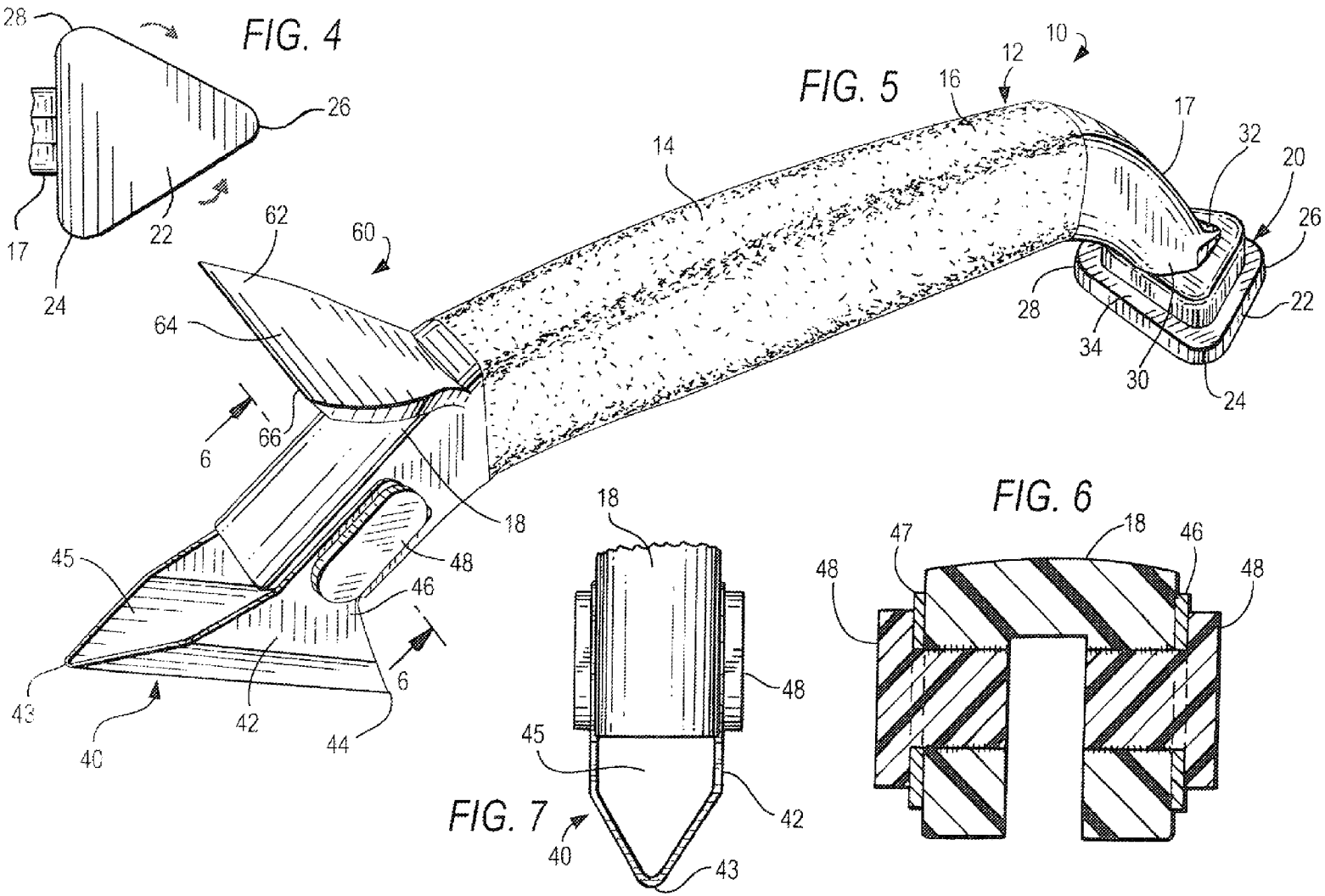
FIG. 4 is a bottom plan view of the triangular member of the first working head taken along lines 4-4 of FIG. 2.
FIG. 5 is a left, rear and top perspective view of the multifunction caulk tool shown in FIG. 1.
FIG. 6 is a cross-sectional view of the connection between the metallic head and the body of the multifunction caulk tool taken along lines 6-6 of FIG. 5.
FIG. 7 is a front elevational view of the second working metallic head attached to the second end of the raised handle.

The second working head 40 comprises a metallic head 42 attached to the descending end 18 of the handle 14. The metallic head 42 is configured with a forward pointed tip 43 and a rearward pointed tip 44 adapted to scoop out and remove old caulk and other debris from joints or seals. The metallic head 42 also comprises a cavity 45 to accommodate a significant amount of caulk and debris before it must be cleaned. As shown in FIGS. 5 and 6, the metallic head 42 is connected to the body 12 with peg members 48, 49. The peg members 48, 49 are sonically welded to the body 12 at the descending end 18 of the body 12, with the upwardly extending ends 46, 47 of the metallic head positioned between opposite sides of the body 12 and pegs 48, 49, respectively. As depicted in FIG. 2, the metallic head 42 is oriented so that the handle 14 and a user's hand holding the tool 10 cannot interfere with the removal of caulk when the rearward pointed tip 44 is used with a rearward or pulling motion. To achieve this result, the bottom surface 52 of the metallic head 42 is oriented at an angle of 65-85 degrees (and most preferably 75 degrees) relative to the axial line formed by raised handle 14.

In the preferred embodiment of the caulk tool 10, a third working head 60 in the form of a scraper 62 is provided adjacent to the second working head 40, at the top of the descending end 18 of the handle 14. The scraper 62 is preferably formed of a hard plastic material like that of the body member 12, but can be formed from a metallic material if desired. The scraper 62 comprises a flat surface 64 and a chisel-shaped head at its tip 66 to assist in the removal of caulk and/or other debris from a work surface, or to otherwise smooth a work surface. Notably, the third working head 60 also serves as a guard on which a thumb (or other finger) may rest and be protected from harm during use of the second working head 40 to remove old caulk. The presence of the third working head 60 also serves to stabilize the tool 10 in the hand during use. These features are particularly advantageous when a swift or violent stroke may be needed to remove caulk or debris from an area that is hazardous.

While the third working head 60 is preferably provided adjacent to the second working head 40, it should be understood that a similarly configured head may be provided adjacent to the first working head 20 instead of or in addition to the third working head 60 shown and described herein.

The accompanying drawings only illustrate a multifunction caulk tool and its constituent parts, however, other types and styles are possible, and the drawings are not intended to be limiting in that regard. Thus, although the description above and accompanying drawings contains much specificity, the details provided should not be construed as limiting the scope of the embodiment(s) but merely as providing illustrations of some of the presently preferred embodiment(s). The drawings and the description are not to be taken as restrictive on the scope of the embodiment(s) and are understood as broad and general teachings in accordance with the present invention. While the present embodiment(s) of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention. It should also be noted that the terms "first," "second" and similar terms may be used herein to modify various elements. These modifiers do not imply a spatial, sequential, or hierarchical order to the modified elements unless specifically stated.

The invention claimed is:

1. A multifunction caulk tool comprising:

a body member having a raised handle and a first descending end and a second descending end;

a first working head positioned at said first descending end, said first working head including a triangular appendage and a triangular member, formed of a soft plastic material, having three tips of varying size to smooth caulk beads; and a second working head positioned at said second descending end, said second working head having a forward pointed tip and a rearward pointed tip adapted to scoop out and remove old caulk and other debris from joints or seals;

wherein said triangular member includes a cavity, and said triangular appendage is inserted inside said cavity snuggly securing said triangular member to said multifunction caulk tool for low-friction pivotal rotation, whereby the triangular member may be rotated enabling any one of said tips to be positioned to smooth caulk beads.

2. The multifunction caulk tool of claim 1, wherein said triangular member is formed of a soft rubber material.

3. The multifunction caulk tool of claim 2, wherein said soft rubber material is a silicon rubber.

4. The multifunction caulk tool of claim 1, wherein said triangular member is formed of a low-friction material.

5. The multifunction caulk tool of claim 1, wherein said second working head is metallic.

6. The multifunction caulk tool of claim 1, wherein said triangular member is sufficiently flexible to be rotated by a moderate amount of force.

7. The multifunction caulk tool of claim 6, wherein one of said three tips is sized to accommodate a 3/16" joint.

8. The multifunction caulk tool of claim 6, wherein one of said three tips is sized to accommodate a 1/4" joint.

9. The multifunction caulk tool of claim 6, wherein one of said three tips is sized to accommodate a 3/8" joint.

10. The multifunction caulk tool of claim 1, further comprising a third working head, said third working head comprising a flat scraper.

11. The multifunction caulk tool of claim 10, wherein said third working head is positioned adjacent to said second working head.

12. The multifunction caulk tool of claim 10, wherein said scraper is formed of a hard plastic material.

13. The multifunction caulk tool of claim 1, further comprising a third working head, said third working head comprising a finger guard to protect a user's finger when said tool is in use.

14. The multifunction caulk tool of claim 13, where said third working head is positioned adjacent to said second working head.

15. A multifunction caulk tool comprising:

a body member having a handle with a first end and a second end;

a first working head positioned at said first end of said handle, said first working head including a triangular appendage and a rotatable triangular member, formed of a soft plastic, having three tips of varying size to smooth caulk beads; and a second working head positioned at said second end of said handle, said second working head having a forward pointed tip and a rearward pointed tip adapted to scoop out and remove old caulk and other debris from joints or seals;

wherein said triangular member includes a cavity, and said triangular appendage is inserted inside said cavity snuggly securing said triangular member to said multifunction caulk tool for low-friction pivotal rotation, whereby the triangular member may be rotated enabling any one of said tips to be positioned to smooth caulk beads.

16. The multifunction caulk tool of claim 15, wherein said triangular member is formed of a soft rubber material.

17. The multifunction caulk tool of claim 16, wherein said soft rubber material is a silicon rubber.

18. The multifunction caulk tool of claim 15, wherein said triangular member is formed of a soft plastic material.

19. The multifunction caulk tool of claim 15, wherein said triangular member is formed of a low-friction material.

20. The multifunction caulk tool of claim 15, wherein said three tips are curved to form a concave surface when a caulk bead is smoothed.

21. The multifunction caulk tool of claim 15, wherein one of said three tips is sized to accommodate a 3/16" joint.

22. The multifunction caulk tool of claim 15, wherein one of said three tips is sized to accommodate a 1/4" joint.

23. The multifunction caulk tool of claim 15, wherein one of said three tips is sized to accommodate a 3/8" joint.

24. The multifunction caulk tool of claim 15, further comprising a third working head, said third working head comprising a flat scraper.

25. The multifunction caulk tool of claim 24, wherein said third working head is positioned adjacent to said second working head.

26. A multifunction caulk tool comprising:

a body member having a raised handle;

a first working head connected to said raised handle, said first working head including a triangular appendage and a manually rotatable triangular member made of a low-friction soft material, said rotatable member having a plurality of tips of varying size to smooth caulk beads;

a second working head connected to said raised handle, said second working head having a forward pointed tip and a rearward pointed tip adapted to scoop out and remove old caulk and other debris from joints or seals;

wherein said triangular member includes a cavity, and said triangular appendage is inserted inside said cavity securing said triangular member to said multifunction caulk tool for low-friction pivotal rotation, whereby the triangular member may be rotated enabling any one of said tips to be positioned to smooth caulk beads.

27. The multifunction caulk tool of claim 26, wherein said rotatable member is triangular.

28. The multifunction caulk tool of claim 26, wherein said rotatable member has three curved tips.

29. The multifunction caulk tool of claim 26, wherein said first working head and said second working head are positioned axially opposed to one another with respect to the handle.

30. The multifunction caulk tool of claim 26, further comprising a third working head positioned adjacent to said second working head, said third working head comprising a flat scraper.

31. The multifunction caulk tool of claim 26, wherein said low-friction soft material is a silicon rubber material.

32. A multifunction caulk tool comprising:

a body member having a raised handle and a first descending end and a second descending end;

a first working head positioned at said first descending end, said first working head comprising a rotatable triangular member made of a soft material having three curved tips of varying size to smooth caulk beads;

a second working head positioned at said second descending end, said second working head having a forward pointed tip and a rearward pointed tip adapted to scoop out and remove old caulk and other debris from joints or seals;

a third working head comprising a flat scraper positioned at one of said first descending end or said second descending end.

33. The multifunction caulk tool of claim 32, wherein said soft material is a silicon rubber.

34. The multifunction caulk tool of claim 32, wherein said soft material is a plastic material.

35. The multifunction caulk tool of claim 32, wherein said soft material is a low-friction material.

36. The multifunction caulk tool of claim 32, wherein said body member comprises polycarbonate resin.

37. The multifunction caulk tool of claim 32, wherein said body member comprises acetyl resin.

* * * * *